US006508245B2

(12) United States Patent
Taplan

(10) Patent No.: US 6,508,245 B2
(45) Date of Patent: Jan. 21, 2003

(54) COOKTOP

(75) Inventor: Martin Taplan, Rheinböllen (DE)

(73) Assignee: Schott Glas, Mainz (DE)

( * ) Notice: Subject to any disclaimer, the term of this patent is extended or adjusted under 35 U.S.C. 154(b) by 0 days.

(21) Appl. No.: 09/808,029

(22) Filed: Mar. 15, 2001

(65) Prior Publication Data

US 2001/0029941 A1 Oct. 18, 2001

(30) Foreign Application Priority Data

Mar. 15, 2000 (DE) ..... 100 12 578

(51) Int. Cl.[7] ..... F24C 3/00

(52) U.S. Cl. ..... 126/39 R; 126/39 J; 126/215; 126/214 A

(58) Field of Search ..... 126/215, 214 R, 126/39 R, 39 J, 214 C, 214 A; 431/328, 327

(56) References Cited

U.S. PATENT DOCUMENTS 3,773,027 A * 11/1973 Dodd ..... 126/39 J
3,941,117 A * 3/1976 Pei et al. ..... 126/215

FOREIGN PATENT DOCUMENTS

| | | | |
|---|---|---|---|
| DE | 197 03 301 | 8/1998 | |
| DE | 198 13 691 | 6/1999 | |
| JP | 62-142926 | * 6/1987 | ..... 126/39 J |
| WO | WO 97/47927 | 12/1997 | |
| WO | WO 99/20942 | 4/1999 | |

* cited by examiner

*Primary Examiner*—James C. Yeung
(74) *Attorney, Agent, or Firm*—Walter Ottesen

(57) ABSTRACT

Modern cooktops typically have a cook surface which is formed by a glass or glass-ceramic plate (1). As an alternative to the electrically heated cooking locations, cooking locations heated by a gas burner, called burner locations (2), can be provided. The heating location is heated by a gas burner. To avoid the use of complex exhaust-gas channels when using gas radiation burners and to further utilize the heat of the exhaust gas for heating the cooking utensil as well as for avoiding the use of separate pot supports when using atmospheric gas burners, the invention provides that the burner location (2) is formed by a mesa-like protrusion (3) in the glass or glass-ceramic plate (1), below which the gas burner (4, 4*a*) is arranged, with the mesa-like surface (3*a*) formed as a pot support surface and with a surrounding flank (3*b*) in which the openings (5, 6) are formed.

11 Claims, 6 Drawing Sheets

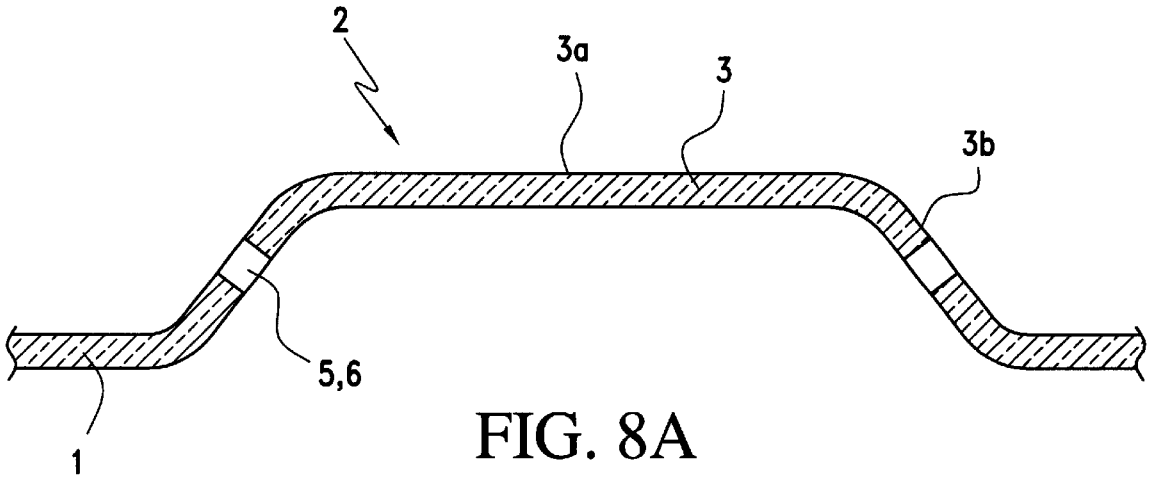
FIG. 8A
FIG. 8B
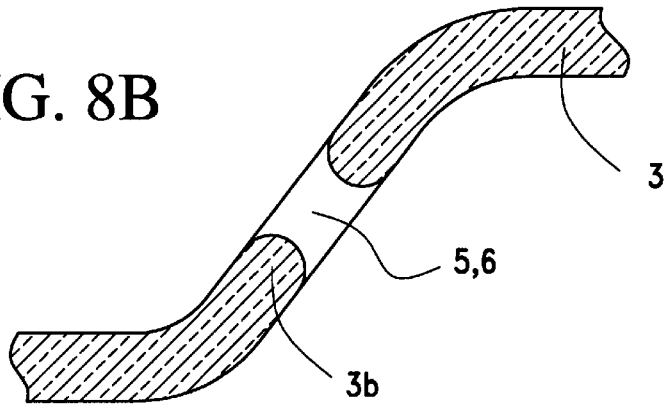
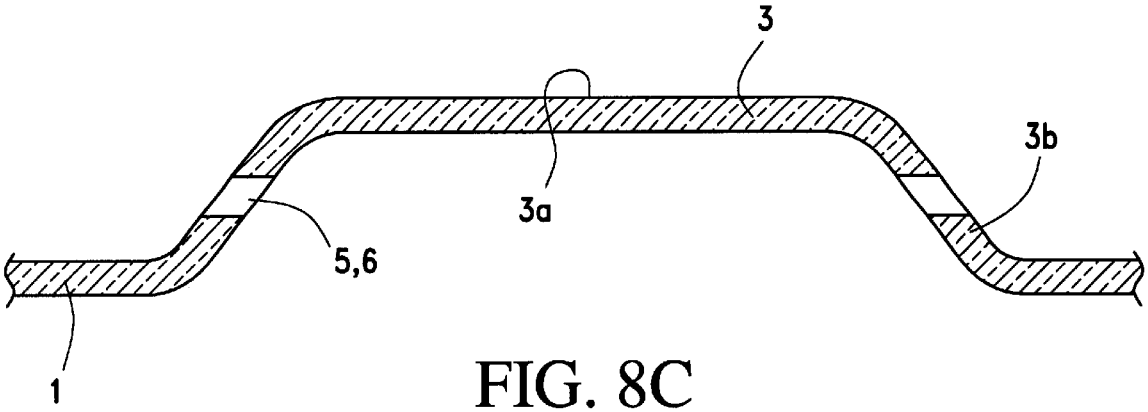
FIG. 8C

COOKTOP

FIELD OF THE INVENTION

The invention relates to a cooktop having a glass or glass-ceramic plate defining a cooking surface and at least one cook location which is heated by a gas burner.

BACKGROUND OF THE INVENTION

Cooktops or ranges having a glass/glass-ceramic plate defining a cook surface and cook locations, which are heated by respective gas burners, have been successfully in the marketplace for many years.

With respect to gas burners, one can distinguish between basically two burner systems:

a) The gas radiation burner, which is mounted below the glass/glass-ceramic plate and whose energy is imparted via radiation to the pot base in a manner similar to the known electric heating element. This burner is a so-called premix burner, that is, all air required for combustion is mixed with the gas in a mixture chamber and combusted at the top side of the burner medium. No additional combustion air (that is, no secondary air) is required on the flame end.

b) The conventional atmospheric gas burner as used for so many years in household ranges. In this type of burner, a part of the combustion air is drawn in by suction with the combustion gas via a venturi nozzle and mixed. However, for a good and complete combustion of the supplied gases, a supply of additional combustion air, the secondary air, is required for the combustion.

The operation and the control performance of both burner systems is different because of the function principle. The radiation burner can be clocked on and off at different time intervals and can thereby be controlled very finely. The atmospheric gas burner is controlled via the quantity of the added gas which usually takes place via the adjustment of the gas valve.

Both burner systems are used in the marketplace even though both systems are still burdened with disadvantages. The radiation burner in the form known today (for example, from German patent publication 197 03 301) is mounted below the closed planar glass/glass-ceramic cooking surface. This means that the hot combustion gas cannot reach the cooking utensil as in the normal atmospheric gas burner; instead, the combustion gas must be conducted away via separate channels from the cooktop. This exhaust-gas guidance requires a high constructive complexity and takes up a considerable amount of space in the cooktop which leads to a substantial limiting of the configuration possibilities. In these radiation burners, the combusted hot exhaust gas cannot be supplied to the actual cooking process. For this reason, the utilization of energy of the cook location is greatly reduced. This defect does not occur in an atmospheric gas burner having an open gas flame as described, for example, in German patent publication 198 13 691. In this type of burner, substantially the largest portion of energy transfer to what is being cooked takes place via the hot exhaust gas. As a significant disadvantage in this burner system, it has been shown in practice that a pot support has to be used over the gas burner to ensure an adequate combustion and to provide a reliable stand for the cooking utensil. This pot carrier is, on the one hand, very expensive with respect to its manufacture and, on the other hand, is burdened with tolerances with respect to centering and configuration and these tolerances can greatly affect the function and support reliability of the cooking utensil. Four pot carriers must be used when utilizing conventionally four burner locations whereby the problem is significantly increased.

SUMMARY OF THE INVENTION

It is an object of the invention to configure the cooktop mentioned initially herein with a glass or glass-ceramic plate as a cooking surface and at least one cook location which is heated by a gas burner so that it is not necessary to configure complex exhaust-gas channels in the case of using gas radiation burners and the exhaust gas can be utilized for heating the cooking utensils or, in the case of atmospheric gas burners, separate pot supports are unnecessary.

The solution of this task is achieved starting from a cooktop having a glass or glass-ceramic plate as a cooking surface and at least one cook location which is heated by a gas burner. This solution is achieved in accordance with the invention in that the burner location is formed by a mesa-like protrusion in the glass or glass-ceramic plate and the gas burner is mounted below this protrusion. The mesa-like surface is the pot position surface and is formed with a peripheral flank in which openings are formed.

In the cooktop according to the invention, the exhaust gases can exit through the openings in the flank in the case of gas radiation burners and can be used additionally to heat cooking utensils placed thereon. No constructively complex exhaust-gas channels transversely across the cooktop are required.

In the case of atmospheric gas burners, the protrusion can be used directly as a pot support. Depending upon the configuration of the gas burner, the openings in the flank can function as passthrough openings for flames or a mixture to be combusted.

International patent publication WO 97/47 927 A1 discloses a gas cooktop having different cook surface levels; however, the known gas cooktop has basically another basic configuration than the cooktop of the invention. It does, in principle, likewise have a glass-ceramic plate as a cooking surface and four cook locations (burner locations) which are heated by respective gas burner positions; however, the configuration of the gas burner positions is basically different than in the case of the invention.

According to the invention, the gas burner locations are each formed by a mesa-like protrusion in the cooking surface plate below which typically a complete (conventional) gas burner is mounted having a burner head including a burner crown and a cover in the case of atmospheric gas burners or a complete gas radiation burner. In the case of four burner locations, a gas burner is assigned to each protrusion, that is, four protrusions and four gas burners are provided. The protrusion surrounds the gas burner with the mesa surface as a pot placement surface and the surrounding flank or the openings formed therein for the exit of the flame or exhaust gas.

In the case of the known gas cooktop, the burner locations are not formed by protrusions in the glass-ceramic plate but by depressions. Also, there is no complete gas burner assigned to the gas burner locations, which would especially heat a pot placement surface; instead, the pot stands between a central area and respective corner areas which are separated by the recesses. Flame openings are formed in the flanks of the opposite-lying recesses. These flame openings are fired by means of a central gas supply (not shown) below the corner areas. The central gas supply in combination with a suitable configuration of the flame openings should allow a desired improved controllability of the gas burner locations. A central gas burner location below the central location could not achieve the desired firing of the gas burner locations.

In accordance with a first embodiment of the invention, the protrusion is configured as a truncated cone. Such a protrusion can be made with simple forming means.

To increase the pot placement surface of the protrusion, it is practical according to a further embodiment of the invention, to configure the protrusion as star-shaped with the three or more stars at an oval or circular base surface. This configuration relates to the star-shaped configuration of the mesa-like shaped protrusion of the cook surface f or directly forming the pot support; in contrast, WO 99/20942 A1 shows only a star-shaped burner head of an atmospheric gas burner to which a conventional pot support is assigned which therefore is not to be replaced.

The openings in the peripherally extending flank can be configured as slots or as circular-round openings depending on the type of gas burner used. Other forms are also conceivable, for example, oval or star-shaped openings. Slots or circular-round holes are, however, simple to form.

According to a further embodiment of the invention, the cooktop is so configured that a conventional gas radiation burner having a mixture chamber and burner medium is mounted below the protrusion and the base surface of the protrusion is so selected that the gas radiation burner can be seal-tight attached along the periphery of the base surface via an insulation ring. The hot exhaust gases, which arise in the space above the burner medium, exit through the openings in the peripherally extending flank and reach the placed cooking utensil without it requiring extensive exhaust-gas channels. This leads to a reduction of the precooking time and to a more efficient utilization of energy.

According to another embodiment of the invention, the cooktop is so configured that a conventional atmospheric gas burner is mounted below the protrusion and the base surface of the protrusion is so selected that the flames of the atmospheric gas burner burn exclusively within the protrusion.

In this way, a separate pot support is unnecessary as required in conventional burner locations having atmospheric gas burners.

In a further embodiment of the invention, the cooktop is so configured that an atmospheric gas burner having an adapted burner crown in mounted below the protrusion and the base surface of the protrusion is so selected that the burner crown of the gas burner with its crown bores is so aligned with openings in the peripherally extending flank against the inner side of the flank that the flames of the atmospheric gas burner burn through the openings. In this way, the flames of the atmospheric burner reach directly to the placed utensil.

In an extension of this concept, and according to a further embodiment of the invention, the cooktop is so configured that an atmospheric gas burner without a burner crown having gas passthrough openings is mounted in the burner head below the protrusion and the protrusion is so configured that the burner head lies so tightly against the inner side of the peripherally extending flank that the air/gas mixture of the atmospheric gas burner passes through the openings in the peripherally extending flank and combusts outside of the flank.

In an embodiment of this kind, the bores in the peripherally extending flank or this flank region assume the function of the burner crown whereby the atmospheric gas burner can be configured of fewer components.

According to another embodiment of the invention, the cooktop is so configured that the openings are so formed in the peripherally extending flank that their longitudinal axes are perpendicular to the flank surface. In an embodiment of this kind, the openings can be formed already in the planar state of the glass or glass-ceramic plate in advance of forming the partial protrusion.

Excellent peripheral protection is given when the openings are so formed in the peripherally extending flank that their longitudinal axes extend parallel to the cook surface formed by the glass or glass-ceramic plate.

BRIEF DESCRIPTION OF THE DRAWINGS

The invention will now be described with reference to the drawings wherein:

FIG. 8A is a section view through the mesa-like protrusion showing the openings in the flank thereof having respective axes perpendicular to the flank surface;

FIG. 8B is a detail section view of the flank showing an opening in the flank having a rounded edge; and, FIG. 8C is a section view showing openings in the flank having respective longitudinal axes parallel to the surface of the cooktop.

DESCRIPTION OF THE PREFERRED EMBODIMENTS OF THE INVENTION

Figure 1:
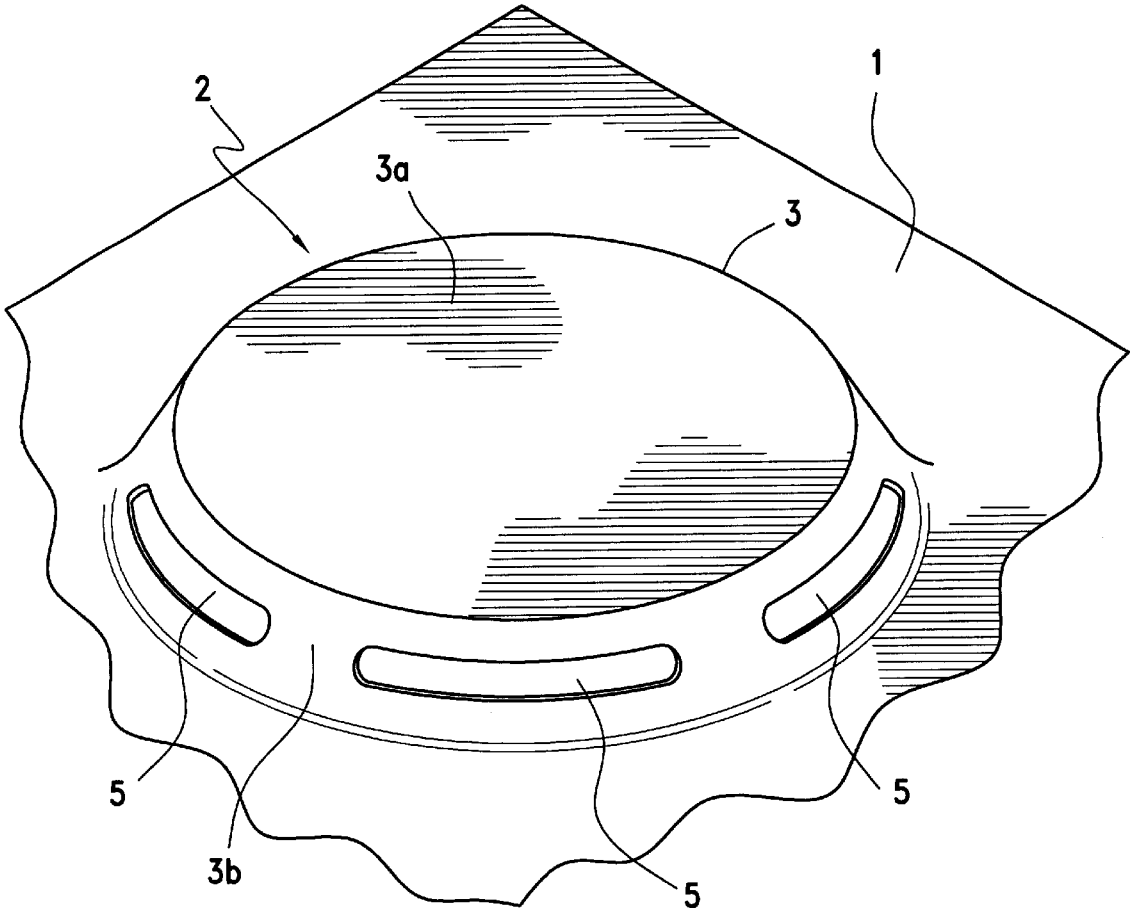
FIG. 1 is a perspective view showing a section of a cooktop having a glass or glass-ceramic plate which has one truncated conically-shaped protrusion, which defines the burner location for the gas burner, and has slots formed in the peripherally extending flanks.

FIG. 1 shows, in a perspective view, a section from a cooktop having a glass or glass-ceramic plate 1 which has at least one cooking location 2 heated by a gas burner. The cooking location is therefore referred to in the following as a burner location.

Figure 3:
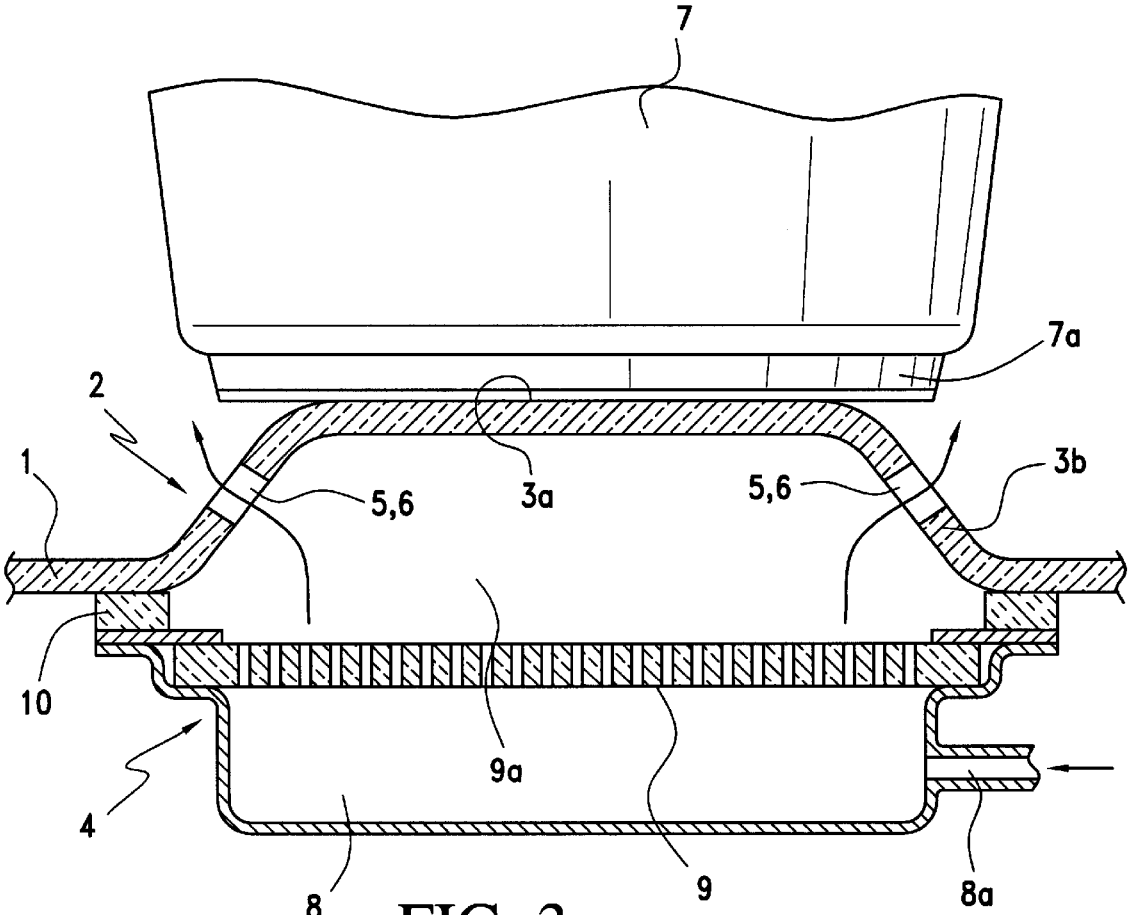
FIG. 3 shows a burner location of FIGS. 1 and 2 in cross section with a gas-radiation burner which is mounted within the protrusion.
Figure 4:
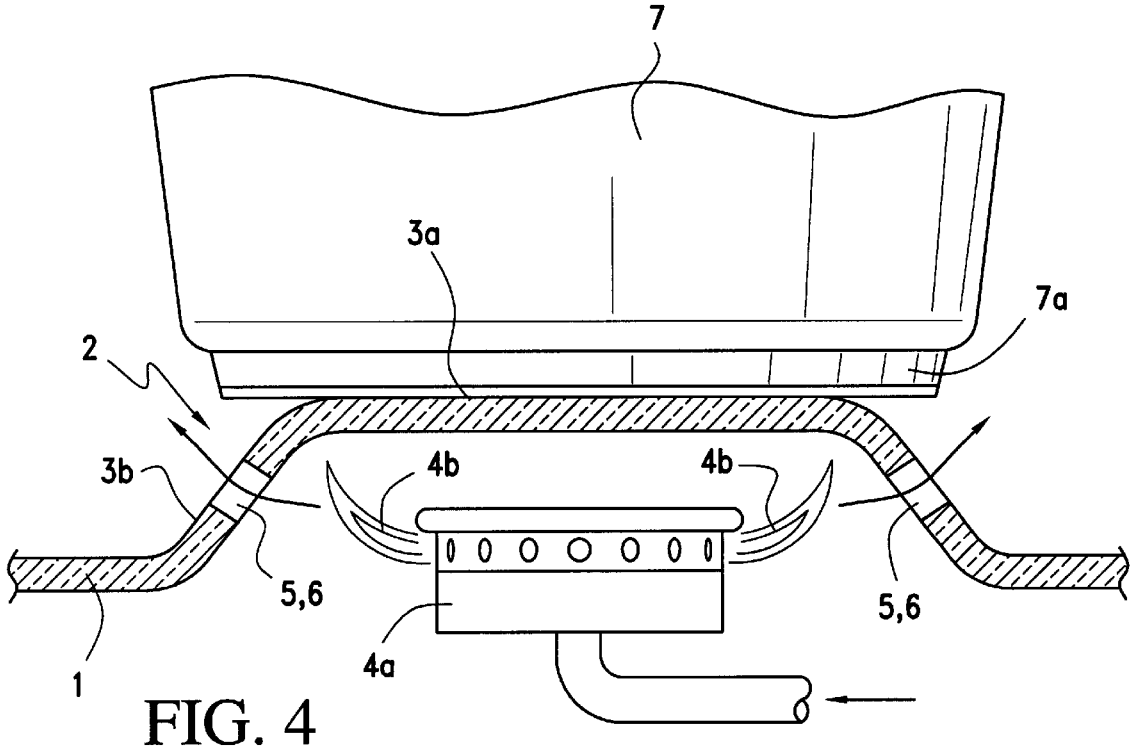
FIG. 4 shows a burner location of FIG. 1 or 2 in cross section with an atmospheric gas burner within the protrusion and with the flames burning completely within the protrusion.

The glass or glass-ceramic plate 1 has a truncated conical shaped protrusion 3 defining a burner location 2 and beneath which the gas burner (4, 4*a*) is mounted as shown in the cross section views of FIGS. 3 and 4.

The upper truncated conical surface 3*a* defines the pot placement surface; whereas, in the conical surface 3*b* (that is, in the incline of said flank between the glass or glass-ceramic plate 1 and the pot placement surface 3*a*), several slots are formed in the periphery. As will be explained below, these slots 5 function as exhaust-gas openings in the case of radiation gas burners and, in the case of atmospheric gas burners, as passthrough openings for flames or hot exhaust gas or for the gas/air mixture to be combusted.

The burner location 2 is raised by a specific elevation compared to the surface of the glass/glass-ceramic plate 1. The elevation lies typically between 5 to 30 mm. In radiation burners, the elevation lies in the range from 5 to 20 mm and, when using atmospheric gas burners, it lies in the range from 15 to 30 mm.

Figure 2:
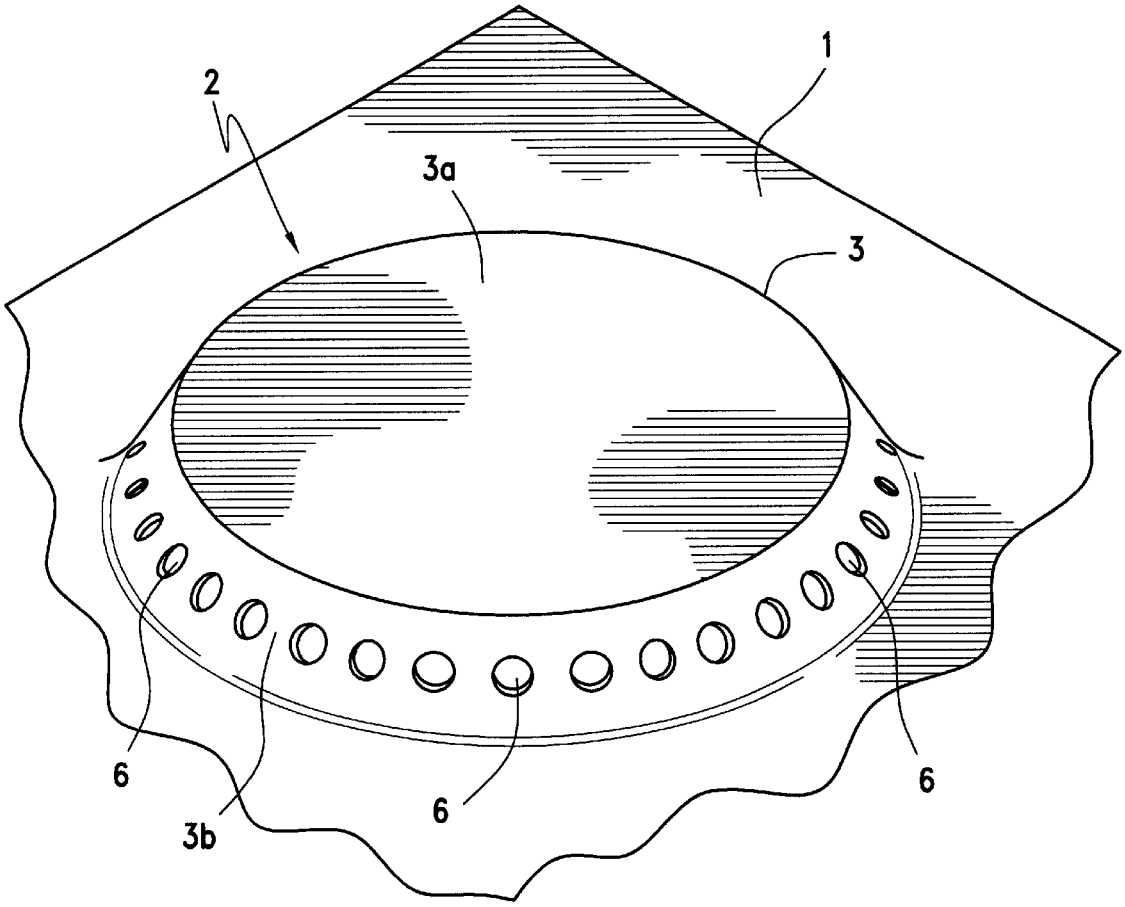
FIG. 2 is a view corresponding to FIG. 1 but with circular-round holes in the peripherally extending flank.

In correspondence to FIG. 1, FIG. 2 shows a conical-truncated shaped protrusion 3 defining the burner location 2 for which there are, in contrast to FIG. 1, no slots in the conical surface 3*b*; instead, a plurality of round openings 6 are formed. Otherwise, the description provided in connection with FIG. 1 applies. Also for the embodiment of FIG. 2, especially the gas-radiation burner as well as the atmospheric gas burner can be used.

In FIG. 3, a radiation-heated burner location 2 of FIG. 1 or 2 is shown in transverse cross section. The gas-radiation burner 4 is disposed below the formed placement surface 3*a* of a cooking utensil 7 and the placement surface is set off compared to the glass/glass-ceramic plate 1. The gas-radiation burner 4 comprises a mixture chamber 8, into which the air/gas mixture flows in via the inlet 8*a*, and the burning medium 9. Here, the burner location can include a perforated ceramic plate made, for example, of aluminum oxide ceramic or even a mat made of metal fibers or SiC fibers. This mat is usually of random nonwoven fibers and can be perforated to improve gas permeability. In lieu of the random nonwoven fibers, fibers in a woven structure can be used. Such gas-radiation burners are state of the art. The radiation burner 4 is pressed via an insulation ring 10 onto the lower side of the glass/glass-ceramic plate. The gas/air mixture combusts on the upper side of the burner medium 9 and heats the latter so that the further energy transfer from the burner medium 9 to the cooking utensil takes place via radiation. The hot exhaust gas, which occurs during combustion, is conducted away from the space 9*a* above the burner medium 9 via the openings (5, 6) in accordance with the selected configuration of FIGS. 1 or 2 and in accordance with the direction of the arrow toward the outside at the region of the edge of the base 7*a* of the cooking utensil 7. In the known systems, which are mentioned initially herein, the exhaust gas is conducted to the outside in especially formed channels below the cooking surface. In contrast, and therefore in the case of the invention, the exhaust gas is used to further warm the cooking utensil 7 which leads to a reduced start-up duration for cooking and to a more efficient utilization of energy.

FIG. 4 shows a burner location of FIG. 1 or 2 in transverse cross section corresponding to FIG. 3. This burner location is heated with an atmospheric burner 4*a*. This conventional atmospheric gas burner 4*a* warms with its own gas flame 4*b* the underside of the glass/glass-ceramic plate 1 which, in turn, transmits its energy to the base 7*a* of a cooking utensil 7 and, additionally, the hot exhaust gas is brought through the openings (5, 6) in the flank 3*b* of the protrusion to the base 7*a* of the cooking utensil and to its periphery.

As shown in FIG. 4, because of the configuration of the invention of the burner location 2, it is possible to dispense with a separate pot support at the burner locations with an atmospheric gas burner.

Figure 5:
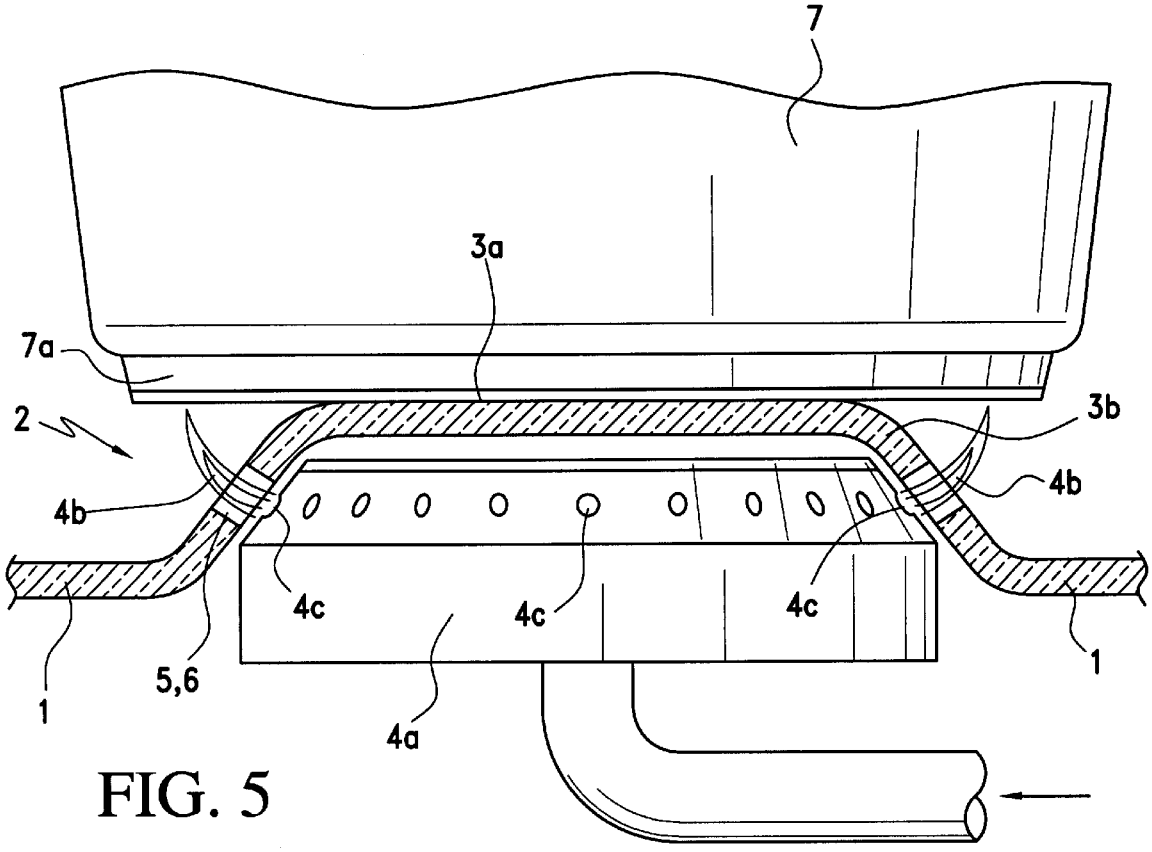
FIG. 5 is a section view corresponding to that of FIG. 4 and shows a variation of the burner location with an atmospheric gas burner within the protrusion and having a burner crown lying so tight against the inner side of the protrusion that the flames exit through the openings in the peripherally extending flank.
Figure 6:
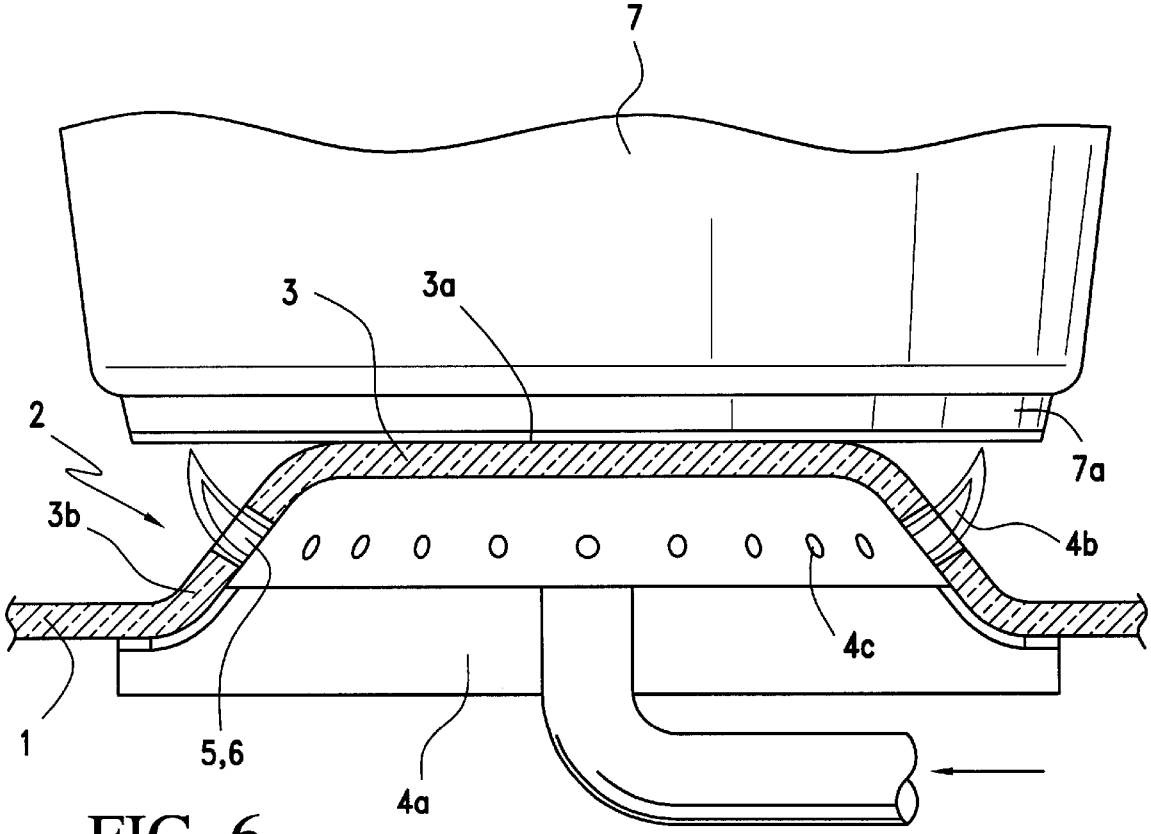
FIG. 6 is a section view corresponding to FIG. 4 of a further variation of a burner location having an atmospheric gas burner within the protrusion with the gas burner having no burner crown and with its burner head lying so tight against the inner surface of the protrusion that uncombusted air/fuel mixture exits through the openings in the peripherally extending flank and combusts outside of the protrusion.

FIGS. 5 and 6 show, as alternatives to FIG. 4, embodiments of a burner location of FIG. 1 or 2 with an atmospheric gas burner 4*a*.

In the embodiment of FIG. 5, the region of the glass/glass-ceramic plate 1, which is formed to define the burner location 2, has a diameter significantly less than for the burner location of FIG. 4. The openings 4*c* of the gas burner crown are located directly behind the openings (5, 6) in the flank 3*b* of the protrusion so that the flames 4*b* of the gas burner can burn through the openings (5, 6) in the flank 3*b*. The openings (5, 6) in the flank 3*b* can either be configured individually for each bore hole 4*c* in the burner crown or can be configured as a longitudinal slot assigned to burner crown bores 4*c* in a group and the flames 4*b* in these slot regions can burn through the flank 3*b*. In the region of the flank 3*b*, in which no openings (5, 6) are located, there are likewise no burn openings 4*c*.

Compared to FIG. 5, there is no separate burner crown of the gas burner 4*a* in the embodiment of FIG. 6. Here, the bores (5, 6) in the protruded glass/glass-ceramic plate 1 directly assume also the function of the burner crown. In this case, the protrusion 3 of the glass/glass-ceramic plate 1 is simultaneously part of the burner 4*a* whereby the burner can be made up of fewer components.

In the embodiments of FIGS. 1 and 2, the protrusion which defines the burner location 2, is configured to have a truncated conical shape on the basis of a circular cone. The pot placement surface 3*a* is therefore of circular shape. The pot placement surface 3*a* must be selected so large that a utensil 7 placed thereon has adequate support.

To permit placing elongated cooking utensils, for example, roasting pans, the protrusion 3 is preferably so configured that an oval pot placement surface (not shown) is formed.

Figure 7:
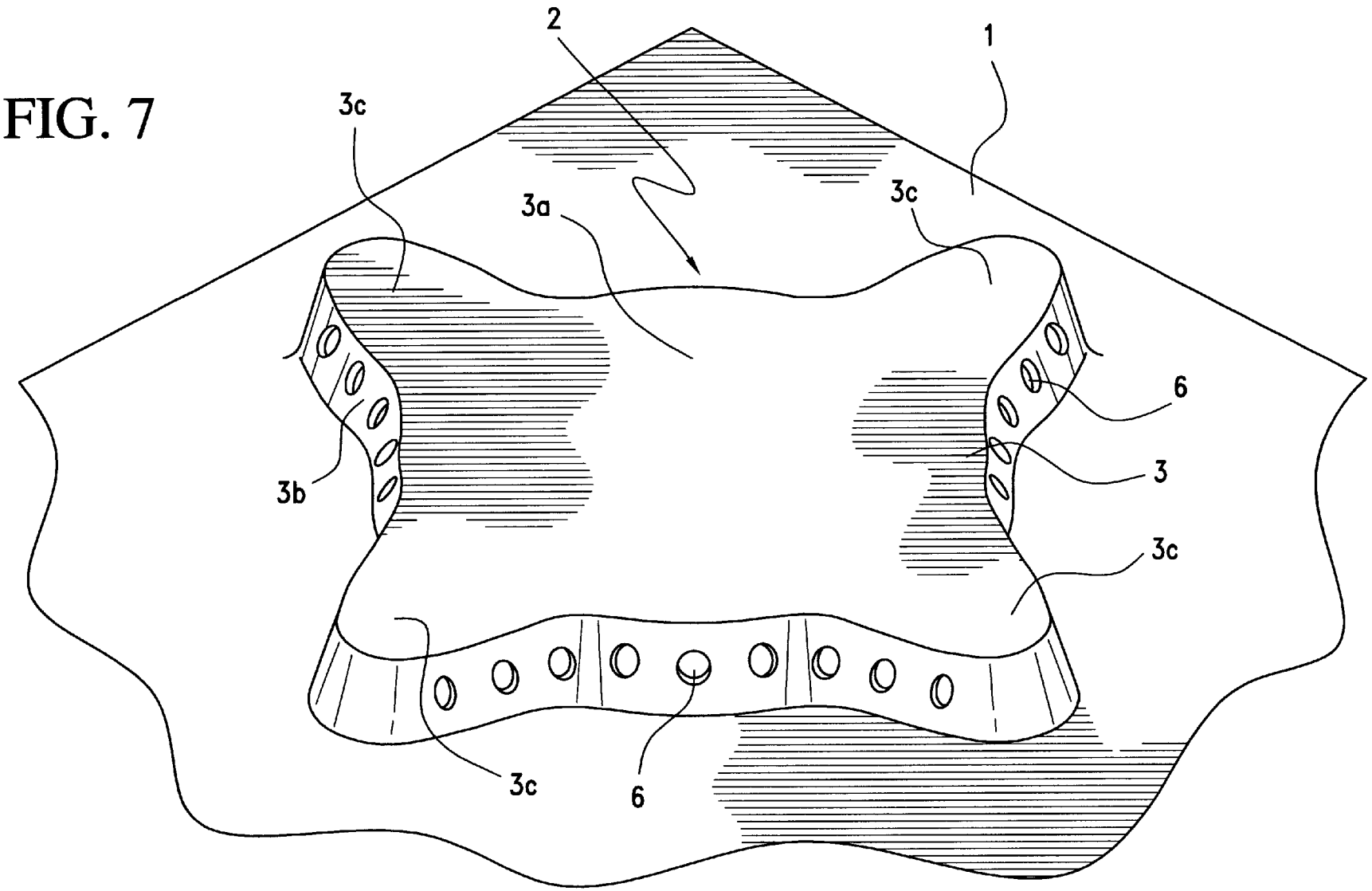
FIG. 7 is a section view corresponding to FIGS. 1 and 2 of a burner location which is formed by a star-shaped protrusion.

FIG. 7 shows a configuration of the protrusion 3 and the pot placement surface 3*a* which affords more support to the cooking utensils and especially large cooking utensils. This configuration proceeds from a round or oval placement center on which fingers 3*c* are arranged in a star-shaped manner for increasing the placement surface 3*a*. This configuration is especially advantageous for atmospheric gas burners in an embodiment according to FIGS. 5 and 6. The burner head of atmospheric burners 4*a* according to FIGS. 5 and 6 is, in diameter, significantly less than the diameter of a radiation burner 4 of FIG. 3. FIG. 4 serves also to make a size comparison. If now the placement surface 3*a*, which is formed from the glass/glass-ceramic plate 1, is reduced significantly in diameter for the cooking utensil 7, then there is no longer adequate support guaranteed for the cooking utensils. This support is again established with the formation of the placement surface 3*a* as a star. Compared to the sketched embodiment with four stars 3*c*, other embodiments with three, five, six or more stars are also possible.

In the embodiment of FIG. 7, the openings 6 in the flank 3*b* of the protrusion 3 are configured, in correspondence to the illustration in FIG. 2, as circular-round openings. In lieu of the round openings 6, slots 5 corresponding to FIG. 1 can be provided. The openings can, in principle, also have another configuration.

The openings 5 or 6 are typically formed in the flank 3*b* of the protrusion 3 and correspond to the illustration in FIG. 8A, that is, their axes are perpendicular to the flank surface.

These breakthroughs (5, 6) in the inclined flanks 3*b* can already be introduced in the planar start glass or are introduced later on the already formed part. The openings (5, 6) can, depending on tolerance requirements and configuration of the openings, be generated by mechanical drills or milling machines or by water jets or laser machining. The introduction of the openings (5, 6) by means of ultrasound is likewise conceivable.

FIG. 8C shows a substantially parallel arrangement of the breakthroughs (5, 6) compared to the glass/glass-ceramic plate plane. This configuration still more efficiently prevents a possible penetration of liquid into the interior of the cooktop. An inclined course of the channels, such as shown in FIG. 8B, however, is, in most cases, already adequate because of a rounding of the opening edges occurs which leads to a reduction of the penetration of possible liquids.

It is understood that the foregoing description is that of the preferred embodiments of the invention and that various changes and modifications may be made thereto without departing from the spirit and scope of the invention as defined in the appended claims.

What is claimed is:

1. A cooktop comprising:

a flat glass or glass-ceramic plate defining a cook surface;

said plate having at least one mesa-like upwardly directed protrusion formed integrally therein to define a cook location;

said mesa-like protrusion including a plateau surface above said cook surface defining a cook placement area for receiving a cooking utensil thereon when the cook location is in use;

a gas burner mounted below said protrusion for supplying heat to said cook location; and, said mesa-like protrusion including a peripherally extending flank between said plateau surface and said cook surface and said flank having a plurality of openings formed therein for passing combustion gases or flames of said gas burner.

2. The cooktop of claim 1, wherein said mesa-like protrusion is configured to have the shape of a truncated cone.

3. The cooktop of claim 1, wherein said mesa-like protrusion is configured to be star-shaped.

4. The cooktop of claim 1, wherein said openings in said flank are formed as slots.

5. The cooktop of claim 1, wherein said openings are configured to be circular holes.

6. The cooktop of claim 1, wherein said gas burner is a conventional gas radiation burner including mixing chamber and a burner medium; said mesa-like protrusion defining a base surface formed on the underside of said protrusion and said base surface having a periphery; and, an insulation ring for attaching said gas radiation burner seal tight along the periphery of said base surface.

7. The cooktop of claim 1, wherein said gas burner is a conventional atmospheric gas burner; said mesa-like protrusion defining a base surface formed on the underside of said protrusion; and, said base surface being so selected that the flames of said atmospheric gas burner burn exclusively within said protrusion.

8. The cooktop of claim 1, wherein said gas burner is a conventional atmospheric gas burner having a burner crown defining a plurality of bores formed therein; said mesa-like protrusion defines a base surface formed on the underside of said protrusion; and, said base surface is so selected that said burner crown lies against the inner side of said flank with said bores of said burner crown aligned with said openings of said flank so that the flames of the atmospheric gas burner burn through said openings in said flank.

9. The cooktop of claim 1, wherein said gas burner is a conventional atmospheric gas burner having a burner head defining a plurality of bores formed therein; said mesa-like protrusion is so configured that said burner head lies tightly against the inner side of said flank so that the air/gas mixture of said atmospheric gas burner passes through said plurality of openings in said flank and combusts outside of said flank.

10. The cooktop of claim 1, wherein said openings are so formed in said flank that the respective longitudinal axes of said openings are perpendicular to the flank surface.

11. The cooktop of claim 1, wherein said openings are so formed in said flank that the respective longitudinal axes thereof extend parallel to the planar cook surface defined by said plate.

* * * * *